US009320336B2

(12) United States Patent
Salo

(10) Patent No.: US 9,320,336 B2
(45) Date of Patent: Apr. 26, 2016

(54) METHOD AND APPARATUS FOR APPLYING POLISH TO NAILS

(71) Applicant: Young Nails, Inc., Anaheim, CA (US)

(72) Inventor: Habib Salo, Marina Del Rey, CA (US)

(73) Assignee: Young Nails, Inc., Anaheim, CA (US)

( * ) Notice: Subject to any disclaimer, the term of this patent is extended or adjusted under 35 U.S.C. 154(b) by 111 days.

(21) Appl. No.: 13/766,406

(22) Filed: Feb. 13, 2013

(65) Prior Publication Data

US 2013/0206156 A1 Aug. 15, 2013

Related U.S. Application Data

(60) Provisional application No. 61/598,492, filed on Feb. 14, 2012.

(51) Int. Cl.

| | |
|---|---|
| ***A45D 31/00*** | (2006.01) |
| ***A45D 29/11*** | (2006.01) |
| ***A45D 29/00*** | (2006.01) |
| ***A45D 34/04*** | (2006.01) |
| *A45D 29/12* | (2006.01) |

(52) U.S. Cl.

CPC ..... *A45D 29/11* (2013.01); *A45D 29/00* (2013.01); *A45D 34/042* (2013.01); *A45D 29/12* (2013.01)

(58) Field of Classification Search

USPC ..... 132/73, 73.5, 75.8, 75.3, 76.2; 248/104, 248/110, 309.1, 230.8; 401/6

See application file for complete search history.

(56) References Cited

U.S. PATENT DOCUMENTS

| | | | | |
|---|---|---|---|---|
| 3,809,977 | A * | 5/1974 | Balamuth et al. | 318/116 |
| 4,190,322 | A * | 2/1980 | Wortley | 359/668 |
| 4,321,935 | A | 3/1982 | Sussman | |
| 4,470,715 | A | 9/1984 | Reuchlin et al. | |
| 4,572,689 | A | 2/1986 | Chernack | |
| D285,011 | S | 8/1986 | Jankewitz | |
| 4,625,740 | A | 12/1986 | Roth | |
| 4,625,741 | A | 12/1986 | Gardiner | |
| D289,088 | S | 3/1987 | Jankewitz | |
| 4,944,318 | A | 7/1990 | Gaylord, Jr. et al. | |
| D311,258 | S | 10/1990 | Jankewitz | |
| 4,998,839 | A | 3/1991 | Bashir | |
| 5,133,369 | A | 7/1992 | Billings | |
| 5,139,357 | A * | 8/1992 | Reents | 401/146 |
| D339,657 | S | 9/1993 | Walker-Shell | |
| 5,298,844 | A * | 3/1994 | Nagasaki et al. | 318/568.11 |
| 5,361,786 | A | 11/1994 | Pangburn | |
| 5,372,742 | A | 12/1994 | Bayless | |
| 5,638,837 | A | 6/1997 | Juhl et al. | |
| 5,645,090 | A | 7/1997 | Juhl et al. | |
| 5,655,554 | A | 8/1997 | Goldberg | |
| 5,690,441 | A | 11/1997 | McManus | |
| 5,724,999 | A | 3/1998 | Kim | |
| 5,762,077 | A | 6/1998 | Griffiths, Jr. | |
| 5,795,219 | A | 8/1998 | Bloom | |
| 5,806,537 | A | 9/1998 | Wittwer | |
| 5,823,203 | A | 10/1998 | Carroll et al. | |

(Continued)

*Primary Examiner* — Robyn Doan

(74) *Attorney, Agent, or Firm* — Nixon Peabody LLP

(57) ABSTRACT

A device for applying decoration to a nail. The device includes an elongated member having a first end having a mounting feature thereon, the mounting feature configured to maintain the first end of the device in a fixed position, and a generally opposite, free-floating end configured to be coupled to a nail decoration, the free-floating end configured to provide controlled movement of the decoration. The elongated member is configured to inhibit unintentional movement thereof.

6 Claims, 5 Drawing Sheets

(56) References Cited

U.S. PATENT DOCUMENTS

| | | | | |
|---|---|---|---|---|
| 5,897,262 | A | 4/1999 | Bratby-Carey | |
| 5,928,457 | A | 7/1999 | Engler | |
| 5,975,088 | A | 11/1999 | Stehman | |
| 6,009,887 | A * | 1/2000 | Hertel | 132/317 |
| 6,035,859 | A | 3/2000 | Antonopoulos-McIvor | |
| 6,071,865 | A | 6/2000 | Pickering et al. | |
| 6,085,756 | A | 7/2000 | Sexton et al. | |
| D429,846 | S | 8/2000 | Herbert et al. | |
| 6,155,270 | A | 12/2000 | Samiean | |
| 6,197,316 | B1 | 3/2001 | Ellingson et al. | |
| 6,296,836 | B1 | 10/2001 | Engler | |
| 6,390,815 | B1 * | 5/2002 | Pond | 433/80 |
| 6,401,724 | B1 | 6/2002 | Sawyer | |
| 6,405,735 | B1 | 6/2002 | Dockery | |
| 6,503,014 | B2 | 1/2003 | Louis et al. | |
| 6,530,709 | B1 | 3/2003 | Washington | |
| 6,575,172 | B1 | 6/2003 | Crosby | |
| 6,615,881 | B2 | 9/2003 | Bartholomew et al. | |
| 6,630,431 | B2 | 10/2003 | Berglund | |
| 6,656,484 | B1 | 12/2003 | Lube et al. | |
| 6,672,341 | B2 | 1/2004 | Bartholomew et al. | |
| 6,675,813 | B2 | 1/2004 | Chu | |
| 6,782,894 | B2 | 8/2004 | Shum | |
| 6,786,667 | B1 | 9/2004 | Thomas et al. | |
| D503,853 | S | 4/2005 | Vickerman et al. | |
| 6,883,561 | B2 | 4/2005 | Bartholomew et al. | |
| 7,125,189 | B2 | 10/2006 | Gueret | |
| 7,185,452 | B2 | 3/2007 | Brown | |
| 7,472,709 | B1 | 1/2009 | Nickerson | |
| D596,351 | S | 7/2009 | Lee | |
| 7,624,769 | B2 | 12/2009 | Bartholomew et al. | |
| D614,335 | S * | 4/2010 | Cham | D26/51 |
| 7,762,268 | B2 | 7/2010 | Baxter | |
| 7,972,075 | B2 | 7/2011 | Tajima | |
| 8,061,365 | B2 * | 11/2011 | Rehkemper et al. | 132/73.6 |
| 8,156,949 | B2 | 4/2012 | Albert et al. | |
| 8,231,295 | B2 | 7/2012 | Armstrong et al. | |
| 8,375,960 | B1 | 2/2013 | Pheng | |
| 2004/0143921 | A1 * | 7/2004 | Borkin | 15/106 |
| 2010/0252058 | A1 * | 10/2010 | Rehkemper et al. | 132/73 |
| 2013/0209155 | A1 * | 8/2013 | Hilton Dunne | 401/6 |
| 2014/0068922 | A1 * | 3/2014 | Roffe | 29/525.08 |

* cited by examiner

METHOD AND APPARATUS FOR APPLYING POLISH TO NAILS

CROSS REFERENCE TO RELATED APPLICATIONS

This application claims priority to U.S. Provisional Application No. 61/598,492 filed Feb. 14, 2012, the contents of which are incorporated entirely herein by reference.

FIELD OF THE INVENTION

The present invention relates generally to a method and an apparatus for applying polish or nail art to a nail. More particularly, the present invention relates to a method and apparatus for quickly and efficiently applying polish or nail art to a nail while substantially preventing the polish or nail art/decorations from being applied to an undesired location on cuticles, surrounding skin, or nail bed, thereby resulting in a "professional" look.

BACKGROUND OF THE INVENTION

Individuals often decorate their fingernails and toenails with nail decorations including paint, nail polish, gel, gel polish (hereinafter referred to collectively as "polish") and/or nail art (e.g., glitter, stickers, decals, rhinestones, crystals, beads, etc.) for cosmetic purposes. Polish is typically applied to the nail with a brush, which coats the nail with the polish.

Polish brushes are typically incorporated into the cap of a polish bottle or container. Thus, when the cap is removed from the bottle, the brush attached thereto generally has the polish thereon. The brush may then contact a user's nail, thereby transferring the polish from the brush to the nail. While this technique is generally effective to apply polish to fingernails and toenails, it is associated with several disadvantages.

For example, using the aforementioned "freehand" technique often causes polish to be undesirably transferred to cuticles and/or skin areas adjacent to the nail on which the polish is being applied. This is particularly likely when a user uses his or her "weak hand" (e.g., when a right-handed user applied polish to his/her right hand using his/her left, "weak" hand). When the brush is applied to the nail, unsteadiness in the user's hand may cause the brush to contact the cuticle and/or skin surrounding the nail. As a result, unwanted and unsightly amounts of polish may be inadvertently applied to surrounding cuticles and/or skin. The unwanted polish may be removed from the cuticles and/or skin using, e.g., a chemical nail polish removing solution. Removing this unwanted polish requires extra time and exposes the user to potentially harmful chemicals.

In attempt to minimize unwanted polish being applied to cuticles and/or skin surrounding a user's nail, the user may spend a substantial amount of time and efforts trying to steady his/her hand to carefully apply the polish. Often, the user's efforts are in vain, and he/she must invest even more time and energy into cleaning and touching up his/her nails and adjacent cuticles and/or skin.

Furthermore, the unsteadiness in a user's hand may result in an uneven application of polish on the user's nail. Often, the finished polish application looks jagged, rough, and/or dull. Thus, it is difficult for a user to achieve a smooth, shiny, "professional-looking" polish application at home.

Likewise, a "freehand" technique is also often used to apply nail art to a user's nail. Because the area of a nail bed is quite small, accurate placement of a piece of nail art is crucial in achieving a desired look or design. However, unsteadiness in a user's hand—particularly a user's "weak" hand—often causes the placement piece of nail art to be at least slightly off, in an undesired location on the user's nail. Moving the piece of nail art to the desired location can be difficult, especially when the piece of nail art is being applied over a coat of polish. Thus, correcting the placement of the piece of nail art may require a user to remove the nail art and polish and restart the entire process, which may be frustrating and inefficient.

Thus, there exists a need for an improved apparatus and method of applying polish and nail art to nails that result in more efficient, desirable results.

SUMMARY OF THE INVENTION

According to one embodiment, a device for applying decoration to a nail is disclosed. The device includes an elongated member having a first end having a mounting feature thereon, the mounting feature configured to maintain the first end of the device in a fixed position, and a generally opposite, free-floating end configured to be coupled to a nail decoration, the free-floating end configured to provide controlled movement of the decoration. The elongated member is configured to inhibit unintentional movement thereof.

According to one process, a method for applying polish to a nail is disclosed. The method includes the act of providing a device comprising an elongated member having a first end with a mounting feature thereon and a generally opposite, free-floating end, the mounting feature configured to maintain the first end of the device in a fixed position, the free-floating end configured to provide controlled movement of the nail polish brush. The method further includes the act of coupling a nail polish brush to an end of the free-floating end of the device. The method further includes the act of intentionally moving at least the end of the free-floating end of the device to apply polish to the nail. The method further includes the act of absorbing unintentional movement of at least the end of the free-floating end of the device.

According to one process, a device for applying polish to a nail is disclosed. The device includes an elongated member. The device further includes a mounting feature coupled to a first end of the elongated member, the mounting feature being configured to maintain the device in a generally fixed position. The device further includes a plurality of segments pivotally coupled to one another and to a second, generally opposite end of the elongated member. The device further includes an attachment feature configured to couple a polish brush to at least one of the segments. The device has an inertial mass sufficient to minimize unintentional movement thereof.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
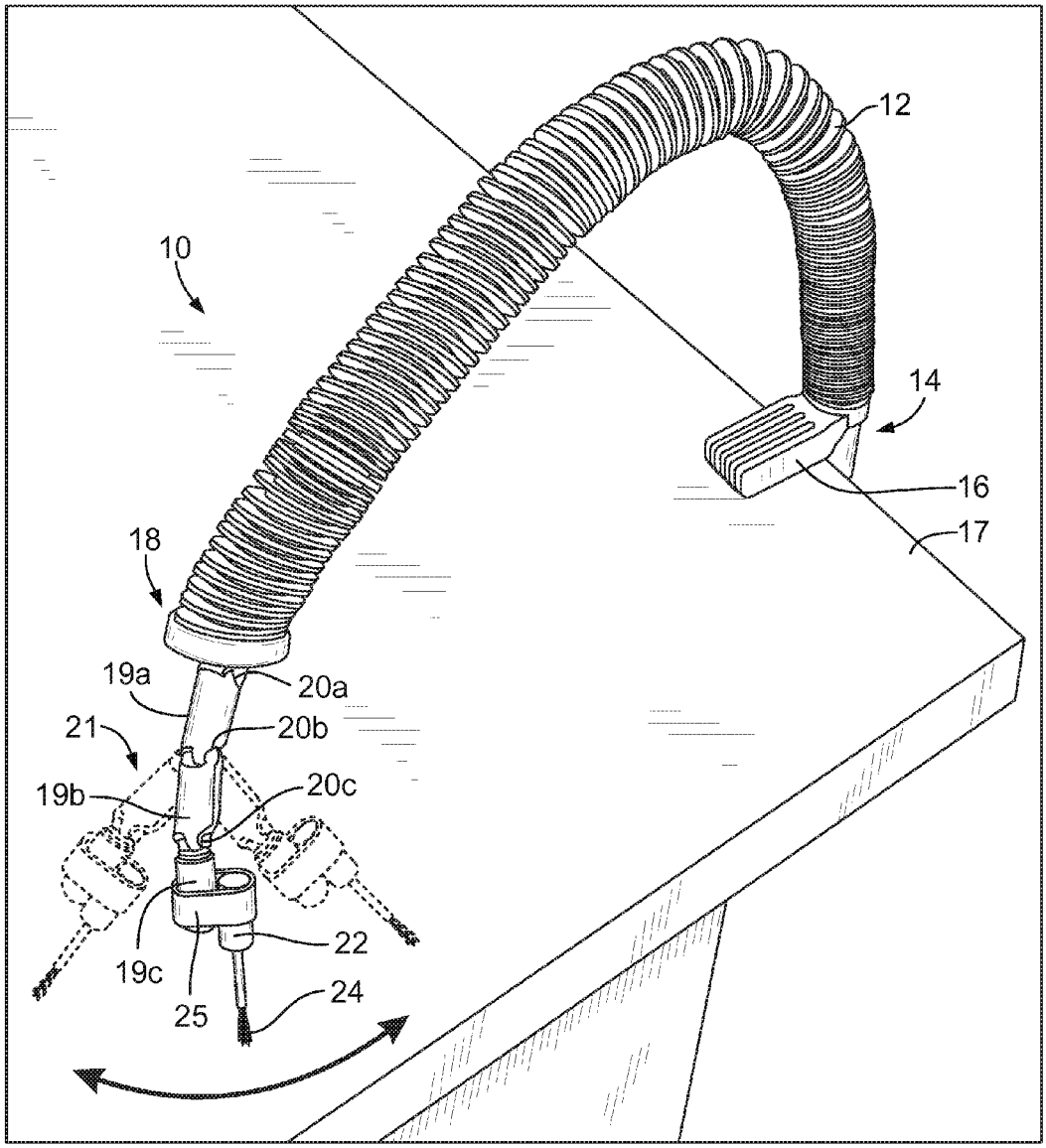
FIG. 1 illustrates a top perspective view of a nail-painting device according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

The present invention is directed toward a method and apparatus for applying polish or other nail decorations to nails.

Figure 2:
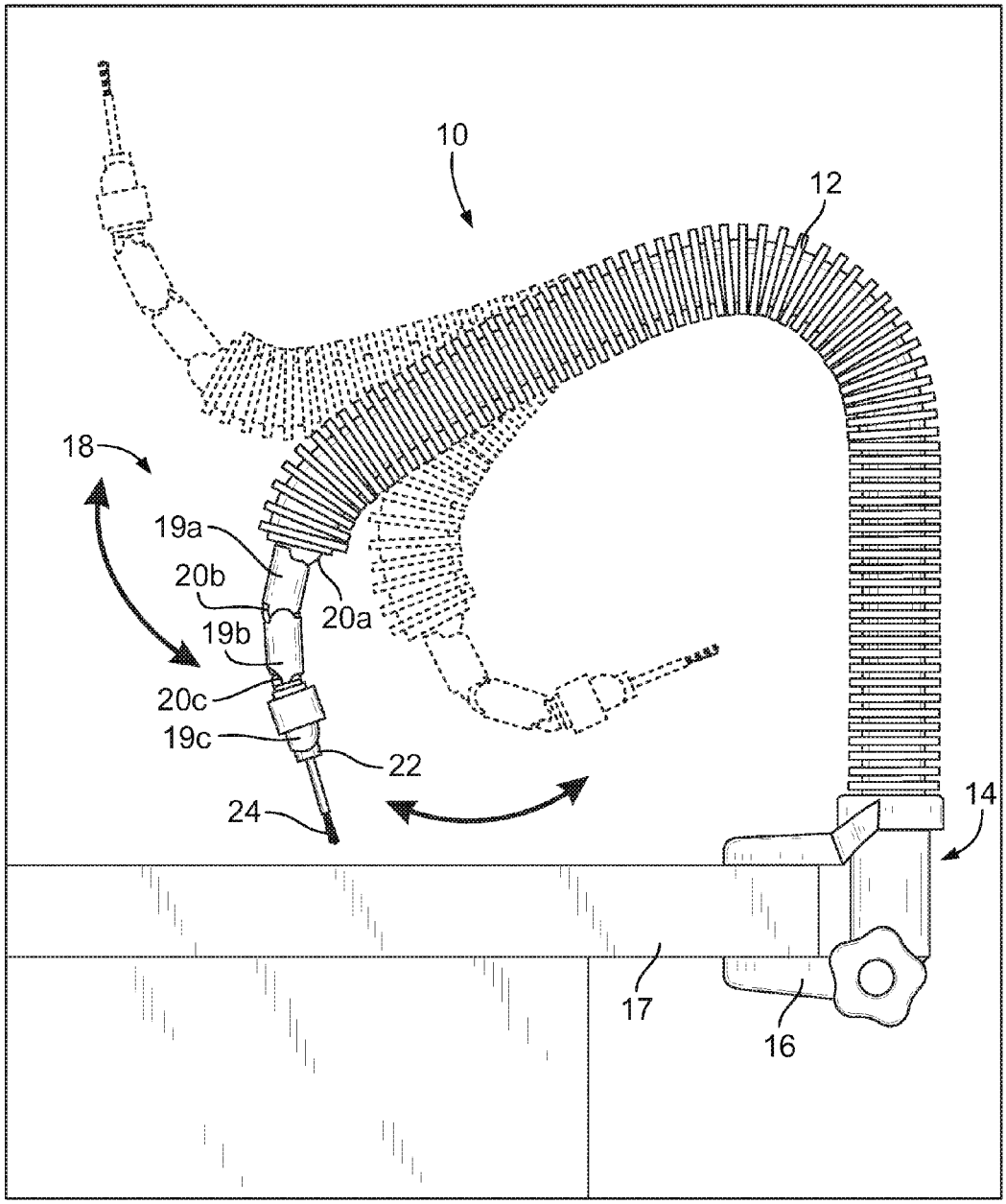
FIG. 2 illustrates a side view of the nail-painting device of FIG. 1.

FIGS. 1-2 illustrate a device 10 according to one embodiment of the present invention. The device 10 includes an elongated member 12 for use in applying paint, nail polish, gel polish, and/or nail art/decorations to a user's fingernails and/or toenails. The elongated member 12 includes a stabilizing first end 14 having a mounting feature 16 thereon. Although not required, according to one embodiment illustrated in FIGS. 1-2, at least a portion of the elongated member 12 is flexible and/or rotatable such that the device 10 and/or components thereof may be adjusted and/or moved to achieve the desired position.

It is contemplated that the mounting feature 16 may include any suitable mechanism for maintaining the device 10 in a relatively stable position. For example, the mounting feature may include a clamp, a suction device, an adhesive, a weight or weighted area, combinations thereof, or the like. In the illustrated example of FIGS. 1-2, the mounting feature 16 includes a clamp for coupling the device 10 to an end of a desk or table 17. The mounting feature 16 maintains the first end 14 of the device 10 in a generally fixed position.

In the illustrated embodiment, a user may adjust the elongated member 12 to a preferred position and/or height suitable for painting the user's nails and/or applying nail art/decorations to the user's nails. Once the user adjusts the elongated member 12 to the desired position and/or height, the elongated member 12 generally maintains that position and/or height until the user affirmatively changes the position and/or height. In other words, as described in more detail below, the elongated member maintains its set position and/or height despite slight inadvertent movements (e.g., shakes, jerks, bumps) by a user.

The elongated member 12 further includes a second, free-floating end 18 positioned generally opposite the first end 14. The free-floating end 18 includes an extension 21 attached thereto. The extension 21 includes a plurality of movable segments 19*a*, 19*b*, 19*c* having a series of pivot points 20*a*, 20*b*, 20*c* attaching the segments 19*a*-19*c* to one another and to the elongated member 12. The pivot points 20*a-c* effectively function like joints by which a user can readily move a nail polish cap 22 and attached brush 24 coupled thereto in any desired direction to any desired position. Although the illustrated embodiments include three segments 19*a*-19*c* and three pivot points 20*a*-20*c*, it is contemplated that another amount of segments and/or pivot points (e.g., one, two, four, etc.) may also be used.

Referring still to FIGS. 1-2, the nail polish cap 22 may be coupled to the extension 21 using any suitable method or device. As shown in FIGS. 1-2, for example, the nail polish cap 22 is attached to the extension 21 using an elastic band 25 wrapped around the nail polish cap 22 and the lower segment 19*c* of the extension 21. In other embodiments (not shown), the extension 21 may include an aperture into which the nail polish cap 22 may be inserted and attached by any suitable mechanism(s).

The extension 21 is generally freely-movable by intentional movement of a user. For example, a user may grasp the lower segment 19*c* to guide the brush 24 along his or her nail to apply polish thereto.

The device 10 absorbs slight, unintentional movements of a user, thereby providing controlled movement of the brush 24. Such unintentional movements may be caused by, e.g., shaking, jerking, and bumping of a user's hand while holding the brush 24 in attempt to apply the polish to his or her nail. To reduce or eliminate such unintentional movements, the inertial mass (or moment of inertia) of the device 10 and portions thereof is sufficiently high so as to not be easily moved by slight, unintentional movements of the user. Thus, the device 10 of the embodiments described herein essentially acts as a "shock-absorber," mechanically isolating a user's unintentional movements from intentional movements of the brush 24, thereby allowing smooth, purposeful, and guided application of the polish onto a user's nail. In this way, the device 10 minimizes the amount of unwanted and unsightly polish inadvertently applied to surrounding skin and/or cuticles. Additionally, the device 10 assists a user in applying polish to difficult-to-reach corners of the nail and in achieving a smooth application of the polish to the nails, thereby resulting in a more "professional" look.

Figure 3:
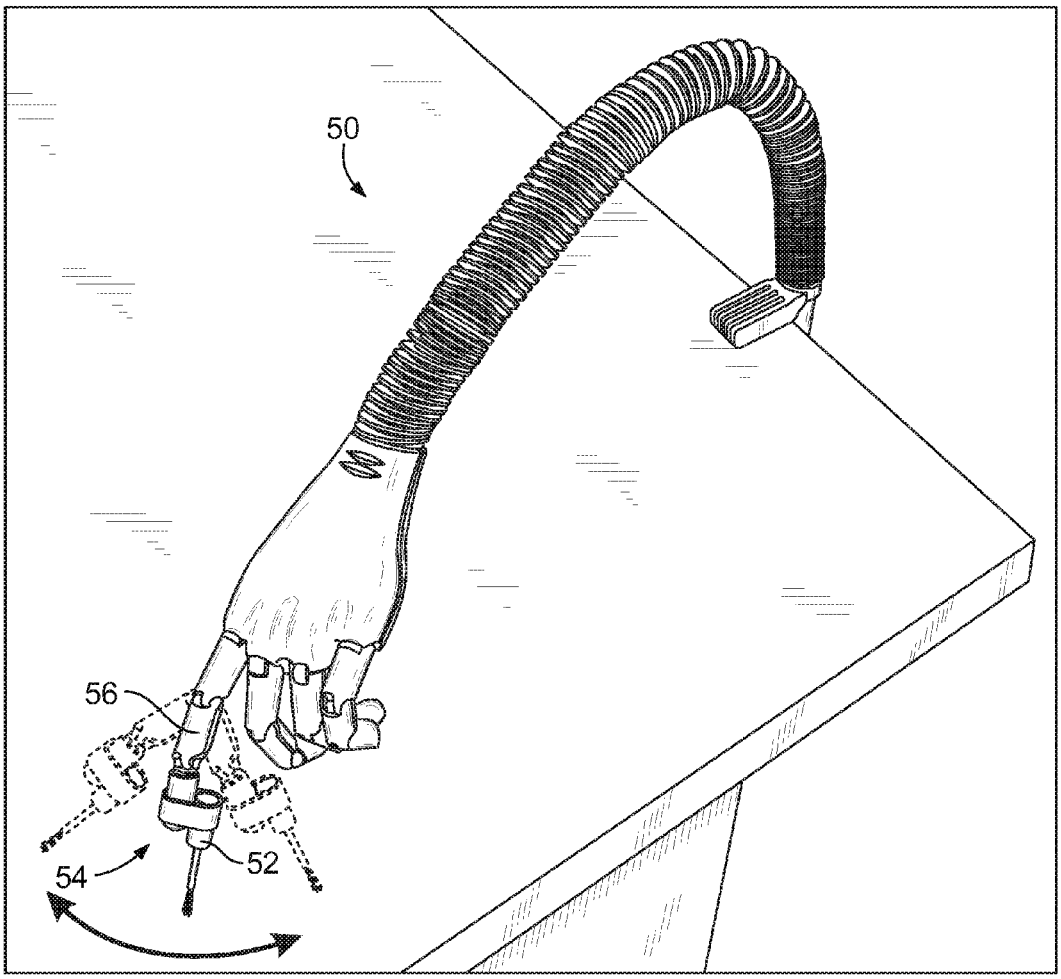
FIG. 3 illustrates a nail-painting device according to another embodiment.

Referring now to FIG. 3, a device 50 is shown according to another embodiment. The device 50 of FIG. 3 resembles a human hand. The device 50 operates in a generally similar manner as the device 10 of FIGS. 1-2. A nail polish cap 52 is attached to a free end 54 of one of the "fingers" 56. This embodiment may be desirable to simulate that a user is actually having his or her nails painted by another person, e.g., a professional manicurist.

Figure 4:
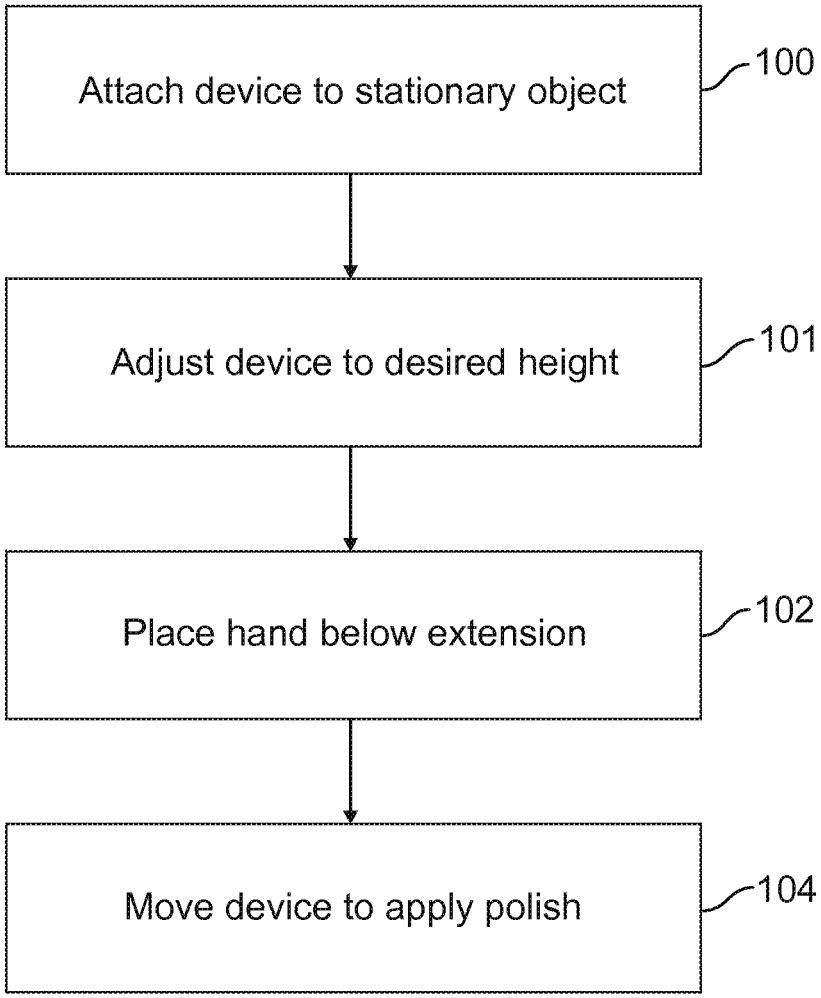
FIG. 4 is a flowchart for a process in accord with at least some aspects of the disclosed concepts.

Referring to FIG. 4 (and FIGS. 1-2), according to one process of operating the device 10 described herein, at step 100, the first end 14 of the device 10 may be contacted to a stationary object, such as a table, desk, or wall, via the mounting feature 16. In embodiments where the mounting feature 16 is, e.g., a suction device, clamp, or adhesive, the device 10 may be attached to the stationary object. In embodiments where the mounting feature 16 includes, e.g., a weight or weight area, the device 10 may simply be placed on top of the stationary object. At optional step 101, a user may adjust the elongated member 12 to a desired height. At step 102, the user may place his or her hand generally below the extension 21 in preparation for applying polish to one of the nails thereon. At step 104, the user may use his or her other or "free" hand to move the extension 21 by rotating and tilting one or more of segments 19*a-c* of the extension 21 such that a stroke of polish is transferred from the brush 24 to his or her nail. Steps 102 and 104 may be repeated until polish is applied to all of the user's nails. The amount of polish transferred to the user's cuticle and adjacent skin area by slight, inadvertent movements of the user's "free" hand will generally be absorbed by the device 10. Additionally, the stability of the device 10 assists in applying a smooth coat of polish to the nail, including hard-to-reach portions of the nail. The resulting polish application will generally be smoother and will require less touch-up and clean-up of unwanted polish by the user. The device 10 is particularly useful in assisting a user in applying polish using his or her "weak" hand (i.e., the user's left hand, if the user is right-handed). Thus, the device 10 requires less time than conventional "freehand" methods and provides enhanced results.

The device described herein may also (or alternatively) be used to apply nail art/decoration (e.g., glitter, stickers, decals, rhinestones, crystals, beads, etc.) to a user's nail. Because the nail is relatively small, any unintentional movement by a user may cause the actual placement of the nail art/decoration, such as a crystal, to significantly vary from the desired placement. Thus, the device of the embodiments described herein may be used to assist in achieving the desired placement of the crystal and/or other type of nail art.

Figure 5:
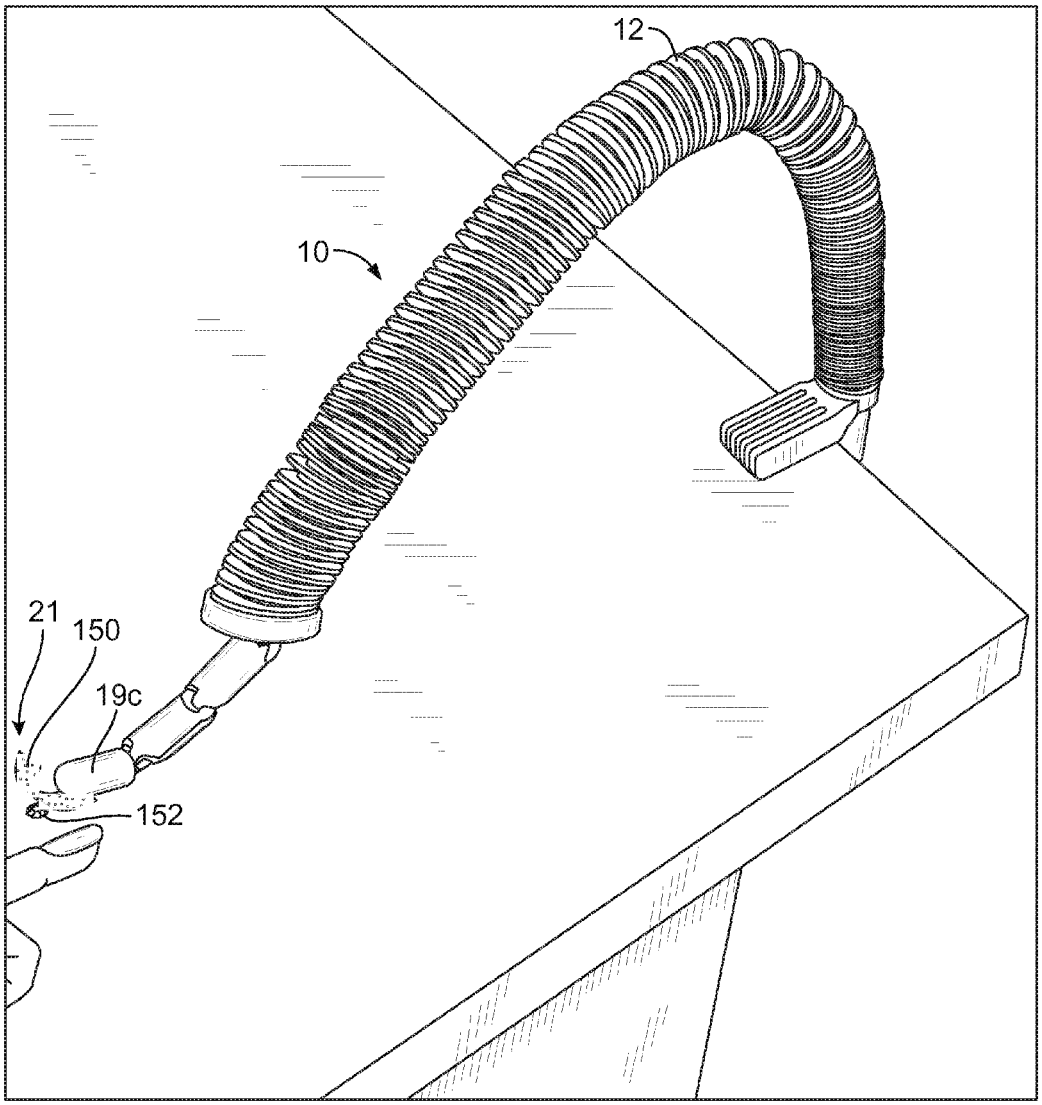
FIG. 5 illustrates a top perspective view of a nail art device according to one embodiment.

With reference to FIG. 5, for example, the lower segment 19*c* may have a slight adhesive or adhesive strip 150 applied thereto. A top of a piece of nail art—in this case, a crystal 152, may be lightly applied to the adhesive strip 150. The user may adjust the elongated member 12 and place his or her nail below the extension 21. The user may move the lower segment 19*c* and/or other portion of the extension 10 so that the crystal 152 is placed precisely on the desired portion of the user's nail. As described above, the user may control the movement of the extension 21 having the crystal 152 attached thereto, while the device 10 absorbs unintentional movement thereof.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A method for applying polish to a nail, the method comprising the acts of:

providing a device comprising an elongated member having a first end with a mounting feature thereon and a generally opposite, free-floating end, the mounting feature configured to maintain a first end of the device in a fixed position, the free-floating end configured to provide controlled movement of the nail polish brush;

coupling the mounting feature to an end of a structure;

coupling a nail polish brush to an end of the free-floating end of the device;

manually and intentionally moving at least the end of the free-floating end of the device to apply polish to the nail; and allowing intentional manual movement and absorbing unintentional manual movement of at least the end of the free-floating end of the device.

2. The method of claim 1, wherein the device has an inertial mass sufficient to absorb the unintentional movement of at least the end of the free-floating end of the device.

3. The method of claim 1, wherein the unintentional manual movement is associated with a natural unsteadiness of a user's hand.

4. The method of claim 1, wherein the free-floating end is pivotable and rotatable.

5. The method of claim 1, wherein the free-floating end further comprises a plurality of segments pivotally coupled to one another.

6. The method of claim 1, wherein the mounting feature includes a clamp, a suction device, adhesive, a weight, a weighted portion, or a combination thereof.

* * * * *